US011298972B1

(12) United States Patent
Zeyger et al.

(10) Patent No.: US 11,298,972 B1
(45) Date of Patent: Apr. 12, 2022

(54) DEVICE FOR PREVENTING PAINT FROM DRYING IN THE CAN

(71) Applicants: Eugene Zeyger, Medfield, MA (US); Leonard Senkovsky, Medfield, MA (US); William Keller, Medway, MA (US)

(72) Inventors: Eugene Zeyger, Medfield, MA (US); Leonard Senkovsky, Medfield, MA (US); William Keller, Medway, MA (US)

(73) Assignee: ZEYGER PRODUCTS LLC, Medfield, MA (US)

( * ) Notice: Subject to any disclaimer, the term of this patent is extended or adjusted under 35 U.S.C. 154(b) by 0 days.

(21) Appl. No.: 17/358,110

(22) Filed: Jun. 25, 2021

Related U.S. Application Data

(60) Provisional application No. 63/102,709, filed on Jun. 29, 2020.

(51) Int. Cl.
*B65D 3/12* (2006.01)
*B44D 3/12* (2006.01)

(52) U.S. Cl.
CPC ..... *B44D 3/127* (2013.01)

(58) Field of Classification Search
CPC ..... B44D 3/127; B44D 3/121; B44D 3/12
(Continued)

(56) References Cited

U.S. PATENT DOCUMENTS 2,167,619 A 8/1939 Bainton
2,556,195 A 6/1946 Kors
(Continued)

FOREIGN PATENT DOCUMENTS

EP 2075202 A1 7/2009
GB 1601124 A 10/1981
(Continued)

*Primary Examiner* — Don M Anderson
*Assistant Examiner* — Madison L Poos
(74) *Attorney, Agent, or Firm* — Lawrence G. Fridman, Esq; Feigin & Fridman, LLC

(57) ABSTRACT

A device for preventing paint from drying in a cylindrical paint can, wherein the paint can has a wall with an internal diameter $D_I$ and an upper portal into the paint can, the upper portal having a diameter smaller than $D_I$. The device consists of a circular planar base disc; and a slanted lip wall extending upwardly from said planar base disc. The lip wall forms a frustum of a cone having a central angle $\alpha$. The slanted lip wall has a first, upper diameter $D_B$ at an upper lip edge of the lip wall, a second, lower diameter $D_C$ at a connection of the slanted lip wall to the planar base disc, and a third diameter $D_M$ disposed between the upper diameter and the lower diameter, wherein $D_M$ is substantially equal to $D_I$, and wherein $D_B>D_M>D_C$ and $D_B>D_I>D_C$. When the device is installed over the paint residue in the paint can, the upper lip edge of the lip wall is deformed so that $D_B$ is substantially equal to $D_I$.

10 Claims, 3 Drawing Sheets

(58) Field of Classification Search
USPC ..... 220/315, 578, 579; 215/231
See application file for complete search history.

(56) References Cited

U.S. PATENT DOCUMENTS

| | | | | | |
|---|---|---|---|---|---|
| 2,828,886 | A * | 4/1958 | Thomas | B44D 3/12 | 220/579 |
| 3,266,662 | A | 6/1966 | Craig | | |
| 4,416,387 | A | 11/1983 | D'Antonio | | |
| 4,625,383 | A | 12/1986 | Burke et al. | | |
| 4,723,674 | A * | 2/1988 | Nunes | B65D 39/02 | 215/231 |
| 5,213,230 | A | 5/1993 | Kral | | |
| 5,339,981 | A * | 8/1994 | Kral | B44D 3/12 | 220/227 |
| 2004/0238544 | A1 * | 12/2004 | Miller | B44D 3/127 | 220/578 |
| 2010/0108182 | A1 | 5/2010 | Noonan | | |

FOREIGN PATENT DOCUMENTS

| | | | |
|---|---|---|---|
| GB | 2141413 | A | 12/1984 |
| GB | 2165813 | A | 4/1986 |

* cited by examiner

DEVICE FOR PREVENTING PAINT FROM DRYING IN THE CAN

CROSS-REFERENCE TO RELATED APPLICATION

The present application claims priority of Provisional Patent Application Ser. No. 63/102,709 filed by the Applicant on Jun. 29, 2020, the entire disclosure of this application is hereby incorporated by reference.

FIELD OF THE INVENTION

The invention relates generally to storage devices, and more specifically, it relates to storage of a remainder of paints or a painting substance in container that has been opened, where the container is a cylindrical can intended for home use.

BACKGROUND OF THE INVENTION

Paint of various types, including paint used for painting home walls, oiling decks, and the like, is typically stored in cylindrical cans, for example formed of metal or plastic. Typically, homeowners and painters buy sufficient paint to complete the painting job and leave some paint left over in case any repair work is necessary in the future. When the paint is initially packaged in the can, there is little to no air in the can, ensuring that the paint remain fresh. However, when storing the residual paint, the upper layer of the paint is exposed to air in the can and tends to dry and/or crust. After some time, the entire paint residue may dry, within the can.

Tightly closing of the cap of the paint can provides some protection from crusting of the paint. However, typically, the seal between the cap and the paint can is incomplete, for example due to deformation of the cap, deformation of the can, or crusted paint disposed around the perimeter of the can. Additionally, the use of some paint in the can results in their being air within the can, which contributes to the crusting of the remaining paint.

Various devices are used in an attempt to preserve the paint in the paint can. Some such devices are formed of a flat thin disc, having a diameter equal to the inner diameter of the paint can. In use, such devices are placed with the disc engaging the surface of the residual paint, to prevent contact of the residual paint with the air. Typically, the portal into a paint can has a smaller diameter than the inner diameter of the body of the paint can. As such, in order to ensure passage of typical paint preserving devices through the portal, the disc is made of a thin, typically elastic, material, to allow its bending during installation. In some cases, the entire disc may be bent or bendable, while in other cases only a peripheral annular region is bendable. Some devices further include a user engageable protrusion extending from the disc, for the user to be able to place and remove the disc.

One disadvantage of the paint preserving devices of the prior art is that when a thin disc is inserted into a paint can, only a narrow edge of the disc contacts the can wall. Thus, when the disc is moved down along the can wall toward the surface of the paint, the disc typically skews from the horizontal, or from being parallel to the base of the can. As a result, paint often flows over the edge of the disc since the can has contact with its wall only along a narrow edge. This is particularly problematic in cans having a small diameter, where the disc can be placed using only one hand.

Another disadvantage is that a disc that contacts the can wall only along a narrow edge of the disc, does not ensure reliable sealing between the disc and the wall, and may allow air to enter and dry the paint.

There is thus a need in the art for a device for preventing paint from drying in the can or a paint preserving device which ensures that the paint will not flow over the device, and that provides for a better seal between the device and the paint can.

SUMMARY OF THE INVENTION

The invention relates to a device for ensuring that a remainder of paint in a paint can that has been opened does not dry. In accordance with one aspect of an embodiment of the present invention, there is provided a device for preventing paint from drying in a cylindrical paint can, wherein the paint can has a wall with an internal diameter $D_I$ and an upper portal into the paint can, the upper portal having a diameter smaller than $D_I$. The device consists of a circular planar base disc; and a slanted lip wall extending upwardly from said planar base disc. The lip wall forms a frustum of a cone having a central angle $\alpha$. The slanted lip wall has a first, upper diameter $D_B$ at an upper lip edge of the lip wall, a second, lower diameter $D_C$ at a connection of the slanted lip wall to the planar base disc, and a third diameter $D_M$ disposed between the upper diameter and the lower diameter, wherein $D_M$ is substantially equal to $D_I$, wherein $D_B>D_M>D_C$ and $D_B>D_I>D_C$, The device is flexible and resilient, and wherein, when the device is installed over the paint residue in the paint can, the upper lip edge of the lip wall is deformed or compressed so that $D_B$ is substantially equal to $D_I$, and at least a part of the lip wall seals against internal diameter of the wall of the paint can.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DESCRIPTION OF THE INVENTION

Figure 1:
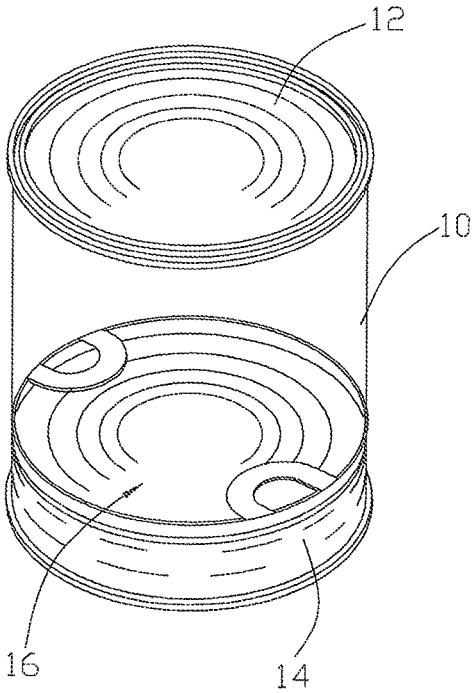
FIG. 1 is a perspective view illustration of a paint can having a paint residue, the paint residue being covered by a device for preventing paint from drying in the can or a paint preserving device according to an embodiment of the present invention.

Reference is now made to FIG. 1, which is a perspective view illustration of a paint can 10 having paint residue 14 disposed therein, the paint residue being covered by a device for preventing paint from drying in the can or a paint preserving device 16 according to an embodiment of the present invention.

As seen, paint can 10 is typically a cylindrical can having a round footprint and being sealable by a cap 12. Following use of some of the paint in the can, paint residue 14 remains at the bottom of the can, here illustrated as filling approximately the bottom quarter of the can. The surface of paint residue 14 is covered by paint preserving device 16, which also engages and forms a seal with an interior circumference of can 10, as described in further detail herein.

Figure 2:
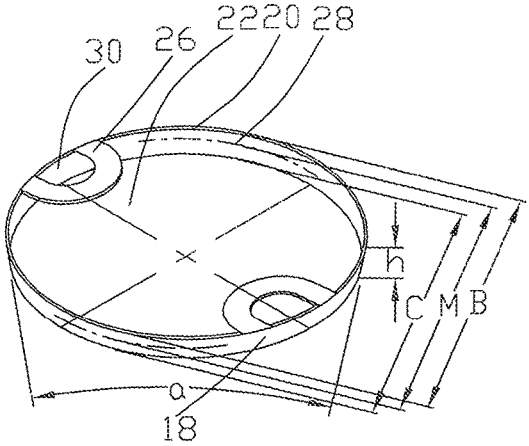
FIG. 2 is a perspective view illustration of a paint preserving device according to an embodiment of the present invention, in a rest state.
Figure 3:
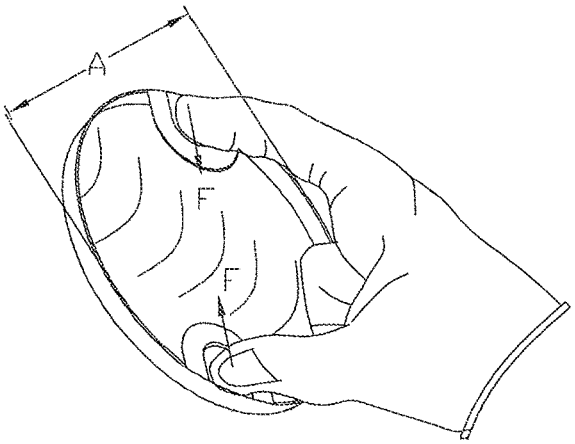
FIG. 3 is a perspective view illustration of the paint preserving device of FIG. 2, in a bent state.

Reference is now additionally made to FIGS. 2 and 3, which are perspective view illustration of paint preserving device 16, in a rest state and in a bent state, respectively.

As seen in FIGS. 2, 3, and in FIG. 7 described in further detail hereinbelow, paint preserving device 16 includes a base 22 surrounded by a slanted lip wall 18, to form the shape of a piston cup seal. The lip wall 18 is slanted to form a frustum of a cone having a central angle $\alpha$ (i.e., if one were to extend the lip wall 18 to complete a cone, the central angle of the cone would be angle $\alpha$) and having a height indicated by h.

Figure 7:
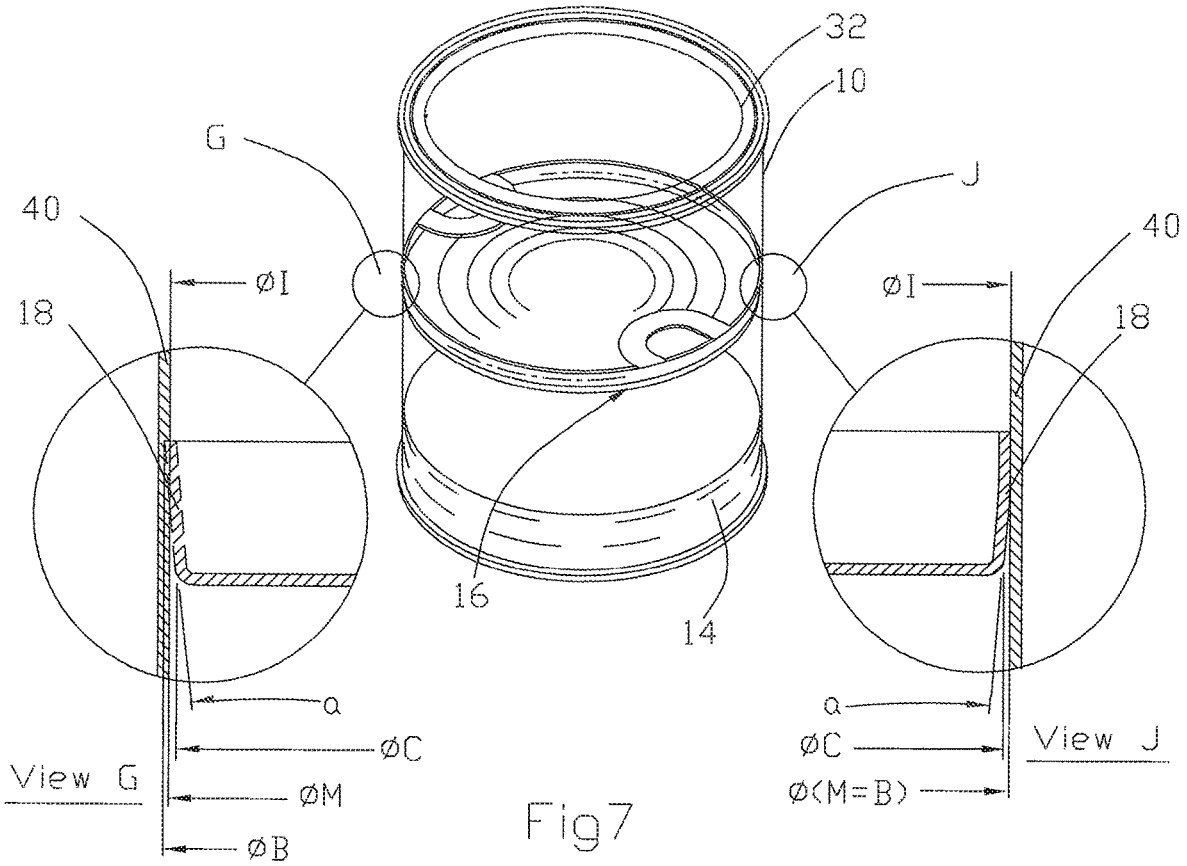
FIG. 7 is a perspective view illustration of a stage of placement of the paint preserving device of FIGS. 2 and 3 over paint residue in a paint can, and enlarged cross-sectional depictions of areas of contact between the paint preserving device and the paint can.

As seen clearly in the enlarged portions of FIG. 7, lip wall 18 forms a continuous wall having the same slant angle throughout the height thereof. Specifically, lip wall 18 is devoid of any internal angles, breaks, or direction changes.

Turning specifically to FIG. 2, it is seen that lip wall 18 has a first, upper, diameter B at an upper lip edge 20 thereof, a second, lower, diameter C at the connection to base 22, which is also the diameter of base 22, and a third, middle, diameter M at a height h of lip wall 18 between lip edge 20 and base 22. The upper diameter B is larger than middle diameter M, which in turn is larger than lower diameter C, such that B>M>C. In accordance with some embodiments of the present invention, the middle diameter M, at height h of the lip wall, is equal to an internal diameter I of the paint can wall 40.

Paint preserving device 16 further includes a pair of user engagement tabs 26 disposed on opposing sides of paint preserving device 16, adjacent upper lip edge 20 thereof. In the illustrated embodiment, user engagement tabs 26 are substantially planar, and are arranged horizontally, substantially parallel to base 22 of the paint preserving device. Each of user engagement tabs 26 includes an inner bore 30 adapted to receive a finger or appendage of the user, as shown in FIG. 3.

When a user engages tabs 26 and applies force in the direction F, as shown in FIG. 3, the paint preserving device, which is formed of a flexible and resilient material, deforms, and turns from having a circular footprint to having a more elliptical footprint, having a smaller diameter indicated by A (FIG. 3) in one direction, and a larger diameter which is the diameter B (FIG. 2) in the opposing direction. When the user releases the pressure applied to tabs 26 the paint preserving device 16 automatically reassumes its initial configuration. As explained in further detail hereinbelow, deformation of paint preserving device 16 may also be used, when the paint preserving device is being installed, to drain air from the space under the paint preserving device, and to ensure direct engagement between the paint preserving device and the residual paint in the can.

Figure 4:
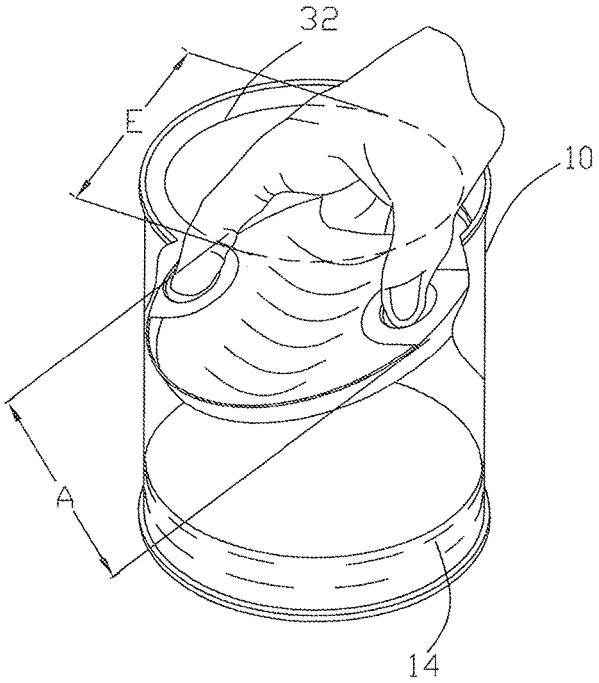
FIGS. 4, 5, and 6 are perspective view illustrations of stages of placement of the paint preserving device of FIGS. 2 and 3 over paint residue in a paint can.
Figure 5:
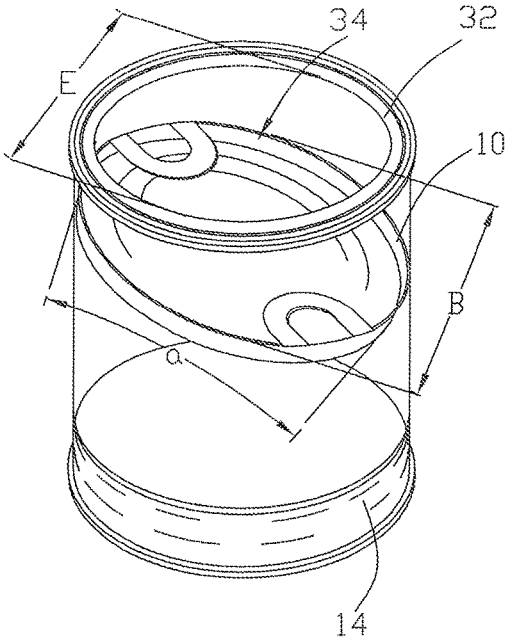
Figure 6:
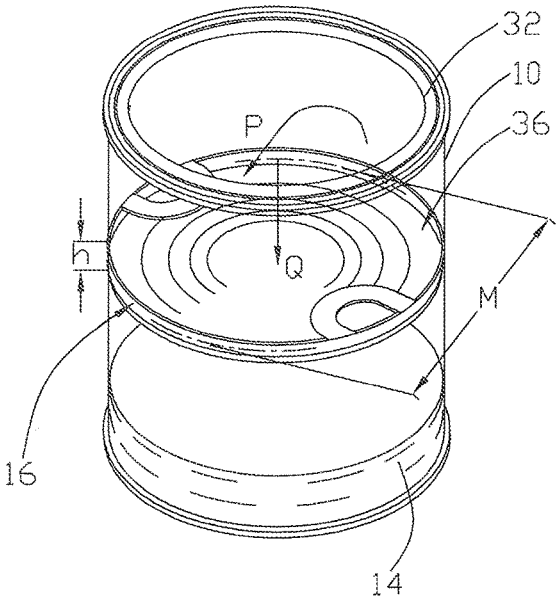

Reference is now made to FIGS. 4, 5, and 6, which are perspective view illustrations of stages of placement of paint preserving device 16 over paint residue 14 in paint can 10, and to FIG. 7, which are perspective view illustrations of paint preserving device 16 over paint residue 14 with enlarged cross-sectional depictions of areas of contact between paint preserving device 16 and paint can 10.

As illustrated in FIG. 4, in a first placement stage, the user engages tabs 26 as shown in FIG. 3 and deforms the paint preserving device 16 such that the paint preserving device has an elliptical configuration having a smaller diameter A. The includes an upper lip edge 20, defining a portal 32 for entry of material into the paint can, which portal has a diameter E. In embodiments of the present invention, the smaller diameter A of the paint preserving device corresponds to diameter E of the portal, or is smaller therefrom, such that the paint preserving device can be inserted into paint can 10 via the portal, with the lip wall 18 being directed upward and being disposed between base 22 of paint preserving device 16 and upper lip edge 20 of the paint can.

As seen in FIG. 5, following insertion of the paint preserving device into the paint can, the user releases the force F, allowing paint preserving device 16 to return to its original, circular shape. However, typically, the base 22 of paint preserving device is inclined, such that the entirety of paint preserving device 16 is in a slanted position 34 relative to a base of paint can 10. At this stage, the dimension B of the smaller diameter of the paint preserving device, which is still somewhat elliptical, is substantially equal to the inner diameter of the paint can.

Turning to FIGS. 6 and 7, it is seen that the user applies a force to paint preserving device 16 in a direction P, to shift the paint preserving device such that base 22 thereof is substantially parallel to the base of paint can 10 and to portal 32, as indicated by reference numeral 36. When straightening the paint preserving device, the lip wall 18 thereof is squeezed or compressed, and upper diameter B of the preserving device, which is greater than the inner diameter of paint can in a rest state of the preserving device, is now equal to the inner diameter 10. This is seen clearly in the enlarged portion labeled "View J" in FIG. 7. The enlarged portion labeled "View G" is an imaginary depiction of what the lip wall of the paint preserving device would not be squeezed or compressed, and the material of the paint preserving device could actually "enter" the material of the paint can wall 40 having an internal diameter I.

As a result of the compression of lip wall 18, paint preserving device 16 assumes a substantially cylindrical shape between height 28 (FIG. 2) and the lip edge 20 thereof, as shown in the enlarged portion "View J". This facilitates a relatively large sealing contact area between the paint preserving device and the paint can. The lower diameter C of the paint preserving device remains smaller than the diameter of the paint can, such that the paint preserving device tapers from height 28 to base 22, as seen in the enlarged portions of FIG. 7.

In some embodiments, lip wall 18 may be deformed by, or may deviate from, contact with the inner wall of paint can 10, for example during pushing of paint preserving device 16 in a downward direction, for example along a longitudinal direction of the paint can, as indicated by arrow Q. Such deformation or deviation facilitates drainage and/or removal of air from the space between paint preserving device 16 and the upper surface of paint residue 14. Because of the resilient nature of paint preserving device 16, the deformation or deviation are not permanent, and the seal between the paint can wall 40 having the internal diameter I and the paint preserving device is re-established upon completion of the motion of the paint preserving device.

Figure 8:
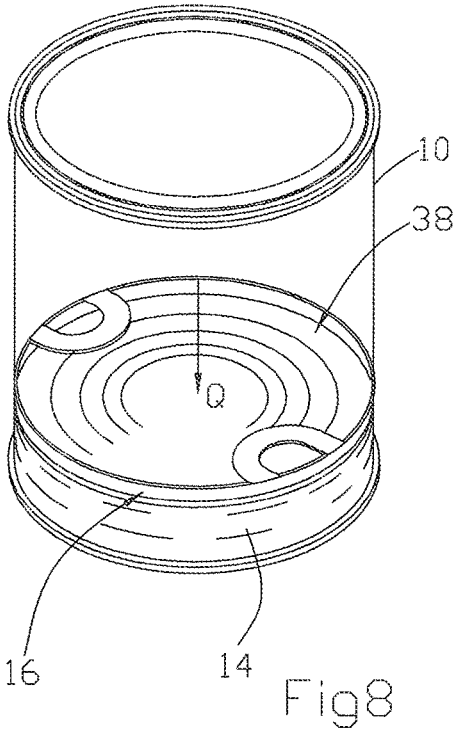
FIG. 8 is a perspective view illustration of the paint preserving device when placed adjacent the paint residue within the paint can, prior to sealing of the paint can by a cap.

Reference is now made to FIG. 8, which is a perspective view illustration of paint preserving device when placed adjacent the paint residue 14 within paint can 10, prior to sealing of the paint can by a cap. As seen, the user has applied a force in the direction indicated by arrow Q, pushing the paint preserving device downward so that a lower surface of base 22 engages an upper surface of paint residue 14, in some embodiments along an entire area of base 22, in a position labeled by reference numeral 38. At the same time, air from under the paint preserving device 16 is drained through one or more micro gaps between lip wall 18 and the inner wall of paint can 10. One indication for the user to know that the base 22 of paint preserving device 16 engages the entire surface of paint residue 14 may be the appearance of light traces of paint around lip edge 20 of lip wall 18.

Once such traces appear, the paint can is ready to be sealed using cap 12 (FIG. 1). When re-using paint, paint preserving device 16 is removed from paint can 10 in reverse order to that described herein with respect to FIGS. 4-7. To facilitate the removal of the paint preserving device 16, it is necessary for the user to pull lip edge 20 of lip wall 18 away from the wall 40 of paint can 10, for example behind tabs 26, in order to eliminate the vacuum effect that would be caused by pulling the paint preserving device directly upward, toward the portal.

In some embodiments, paint preserving device 16 may be formed of polyethylene, having a thickness of approximately 0.05 inches, or in the range of 0.025 inches to 0.075 inches.

In some embodiments, the angle $\alpha$ may be in the range of 3 degrees to 5 degrees. In some embodiments, the angle may be selected to ensure uniform compression of the lip wall 18 during installation of the paint preserving device, as explained hereinbelow, and to ensure that the lip wall will form a cylindrical shape without the appearance of creases or folds therein.

The diameters B, C, and/or M of paint preserving device 16 are selected to suit the inner diameter I of paint can wall 40, typically past the portal thereof. In some embodiments, in which the paint can is a 1 Gallon can or a 2.5 Liter can, the middle diameter M, may be 6.5 inches or 165 mm.

Experiments were conducted using the paint preserving device of the present invention within a 1.0-gallon paint can, in which approximately one quarter of the paint had remained after the painting job was complete. After four years of storage of the paint can, no crust had formed on the surface of the paint, and the consistency of the stored pain fully corresponded to the consistency of the same paint when the can was newly opened, and the paint was fresh.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

What is claimed is:

1. A device for preventing paint from drying in a cylindrical paint can having a wall with an internal diameter $D_I$ and an upper portal into the paint can, the upper portal having a diameter smaller than $D_I$, the device comprising:

a circular planar base disc; and a slanted lip wall extending upwardly from said planar base disc, said lip wall forming a frustum of a cone having a central angle $\alpha$, said slanted lip wall having a first, upper diameter $D_B$ at an upper lip edge of said lip wall, a second, lower diameter $D_C$ at a connection of said slanted lip wall to said planar base disc, and a third diameter $D_M$ disposed between said upper diameter and said lower diameter, said device further comprising a pair of user engagement tabs disposed on opposing sides of said device, each said engagement tab formed with two links attached to said upper lip edge and having an inner bore formed therebetween to receive a finger of a user, said user engagement tabs are substantially flat spaced from and substantially parallel to said planar base disc and remain in spaced parallel to the base orientation during operation of the device;

wherein $D_M$ is substantially equal to $D_I$, wherein $D_B>D_M>D_C$ and $D_B>D_I>D_C$, wherein said device is flexible and resilient, and wherein, when said device is installed over a paint residue in the paint can, the fingers are inserted into the inner bores of said pair of user engagement tabs, as force is applied by said fingers pushing said user engagement tabs toward each other said upper lip edge of said lip wall through its connection with the links is pulled inwardly by said links to be deformed and to form an ellipse having a smaller diameter which is smaller than the diameter of the upper portal of the paint can.

2. The device of claim 1, wherein the central angle $\alpha$ is in the range between 3 degrees and 5 degrees.

3. The device of claim 1, wherein said base and said slanted lip wall together form the shape of a piston cup seal.

4. The device of claim 1, wherein said slanted lip wall is devoid of any internal angles, breaks, or direction changes, between said planar base disc and said upper lip edge of said lip wall.

5. The device of claim 1, including two surfaces, a first planar surface defined by said planar base disc and a second cylindrical surface defined by said lip wall.

6. The device of claim 1, wherein, during downward motion of said device within the paint can, said lip wall engages the internal diameter of the wall of said paint can such that said planar base disc remains substantially parallel to a base of said base can.

7. The device of claim 1, wherein during downward motion of said device within the paint can, deformation of said upper lip of said lip wall allows for drainage of air from an area between said planar base disc and an upper surface of said paint residue, thus ensuring direct contact between said planar base disc and said paint residue and preventing drying of the paint residue.

8. The device of claim 1, wherein the central angle is selected to be in the range between 3 degrees and 5 degrees to ensure that compression of said lip material to cylindrical shape thereof occurs without creases and appearance of folds.

9. The device of claim 1, wherein said lip height is minimized and selected to prevent the disc from skewing as it moves along the can wall until it fully touch the paint surface.

10. The device of claim 1, wherein the central angle $\alpha$ is in the range between 2 degrees and 6 degrees.

* * * * *